United States Patent [19]

Nakamura

[11] Patent Number: 4,638,212

[45] Date of Patent: Jan. 20, 1987

[54] COLOR CATHODE-RAY TUBE

[75] Inventor: Koji Nakamura, Nagaokakyo, Japan

[73] Assignee: Mitsubishi Denki Kabushiki Kaisha, Tokyo, Japan

[21] Appl. No.: 620,702

[22] Filed: Jun. 14, 1984

[30] Foreign Application Priority Data

Jun. 30, 1983 [JP] Japan ..... 58-120829

[51] Int. Cl.[4] ..... H01J 29/07; H01J 29/10

[52] U.S. Cl. ..... 313/408; 313/402

[58] Field of Search ..... 313/402, 403, 407, 408

[56] References Cited

U.S. PATENT DOCUMENTS

| | | | |
|---|---|---|---|
| 2,947,899 | 8/1960 | Kaplan | 313/92 |
| 3,721,853 | 3/1973 | Naruse et al. | 313/402 |
| 4,136,300 | 1/1979 | Morrell | 313/403 |
| 4,162,421 | 7/1979 | Morrell | 313/403 |
| 4,370,591 | 1/1983 | Satoh | 313/402 |

FOREIGN PATENT DOCUMENTS

| | | | |
|---|---|---|---|
| 19909 | 7/1975 | Japan . | |
| 21214 | 7/1975 | Japan . | |
| 39971 | 12/1975 | Japan . | |
| 41648 | 4/1981 | Japan . | |
| 71256 | 6/1981 | Japan . | |
| 34640 | 2/1982 | Japan . | |
| 58-157039 | 9/1983 | Japan | 313/402 |

*Primary Examiner*—Palmer C. DeMeo
*Assistant Examiner*—Sandra L. O'Shea
*Attorney, Agent, or Firm*—Lowe Price LeBlanc Becker & Shur

[57] ABSTRACT

A color cathode-ray tube in accordance with the present invention comprises a set of three electron guns in an in-line array, a shadow mask with a curved surface having a plurality of circular small apertures and a fluorescent screen with a curved surface disposed in parallel with the above stated shadow mask and including fluorescent dots arrayed in association with three electron beams passing through the above stated small apertures. The above stated shadow mask includes, in the flat state before pressed to have the curved surface, the X axis through the center of the flat mask being horizontal in parallel with the direction of the above stated in-line array and the Y axis through the center being vertical to the X axis. Rows of the apertures in the X axis direction are curved more prominently in the shape of a barrel according to increase of the distance from the X axis and columns of the apertures in the Y axis direction are all straight lines parallel to the Y axis.

7 Claims, 12 Drawing Figures

COLOR CATHODE-RAY TUBE

BACKGROUND OF THE INVENTION

1. Field of the Invention

The present invention relates to a color cathode-ray tube (CRT) of a dot-in-line type. More specifically, the present invention pertains to a color CRT in which electron guns are in an in-line array and apertures of a shadow mask are circular and particularly to an array of the apertures.

2. Description of the Prior Art

A color CRT of a dot-in-line type includes a set of three electron guns in an in-line array for emitting three electron beams for three different colors. Ahead of the electron guns, a shadow mask with a curved surface is disposed in a direction intersecting with the electron beams and, further ahead of the shadow mask, a fluorescent screen having a curved surface similar to the curved surface of the shadow mask is provided in parallel with the shadow mask. The shadow mask has a large number of small circular apertures, in a dotted manner, instead of elliptical or slitted apertures.

One of the problems in the landing characteristics of the electron beams in such a conventional dot-in-line type color CRT is, as described in the official gazettes of Japanese Patent Publication Nos. 21214/1975 and 19909/1965, that the pattern of arrival points of the electron beams on the fluorescent screen does not become one having a close packed structure.

FIG. 1 is a schematic illustration for explaining a relation between a set of electron beams in an in-line array and an array of apertures of a shadow mask. In FIG. 1, the in-line array of electron beams is provided parallel to the horizontal direction of a fluorescent screen 1, electron beams for blue, green and red colors being shown on an enlarged scale as BB, BG and BR, respectively. As shown in FIG. 1, it is assumed that an X axis parallel to the in-line array passes through the center of the fluorescent screen and a Y axis vertical to the X axis also passes through the center. In an inserted circle A in FIG. 1, a part of an array of apertures of a shadow mask 2 set near the fluorescent screen 1 is shown on an enlarged scale, with a broken line B as one of lines connecting the nearest apertures out of the apertures 2*a* being parallel with the Y axis. The fluorescent screen 1 is generally formed on the inner surface of a glass panel. Since this glass panel finally constitutes a vacuum vessel for serving as a CRT, the panel is formed to have a spherical surface to prevent an explosive break thereof and the shadow mask 2 is also formed to have a spherical surface corresponding to the fluorescent screen 1.

FIG. 2 is a schematic illustration showing an inclination of a trio of electron beams in each corner portion of the fluorescent screen 1. In FIG. 2, the characteristics of a pattern of arrival points of a trio of electron beams BB, BG and BR in the respective portions of the fluorescent screen 1 after passing through an aperture 2*a* of the shadow mask 2 are illustrated in an exaggerated manner on an enlarged scale. More specifically, since the fluorescent screen 1 has a spherical surface, the arrival points of the trio of beams BB, BF and BR, for example in a corner portion C of the first quadrant, are arrayed downward to the right. FIG. 3 is a detailed illustration, on an even more enlarged scale, showing the arrival points of the electron beams in the corner portion C shown in FIG. 2. In FIG. 3, the arrival points of a trio of electron beams through an aperture 2-1 (not shown) of the shadow mask 2 are shown as $B_1$, $G_1$ and $R_1$, and similarly the arrival points of trios of electron beams through an adjacent aperture 2-2 (not shown) on the right of the aperture 2-1 and an adjacent aperture 2-3 (not shown) on the downward right of the aperture 2-2 are shown as $B_2$, $G_2$ and $R_2$, and $B_3$, $G_3$ and $R_3$, respectively. As seen in FIG. 3, there is a problem that a broken line D connecting the points $B_1$, $G_1$ and $R_1$ and a broken line E connecting the points $B_2$, $G_2$ and $R_2$ are not continuous between the points $R_1$ and $B_2$, causing a step therebetween. In addition, since a broken line F connecting a trio of arrival points $B_3$, $G_3$ and $R_3$ of electron beams through the aperture 2-3 is also inclined as shown in FIG. 3, a distance between the points $B_3$ and $R_1$ becomes extraordinarily short, which constitutes one of the particularly disadvantageous aspects of the landing characteristics in the dot-in-line type of color CRTs.

FIG. 4 is a schematic illustration showing an ideal case corresponding to FIG. 3. The arrival points of electron beams in FIG. 4 form a close packed structure, in which regular triangles respectively formed by the nearest three arrival points are laid most densely. In such an ideal case, the fluorescent screen is utilized most effectively. In other words, the space utilization factor of the screen is at its optimum.

FIG. 5 is a schematic illustration representing a distribution of apertures in a shadow mask utilized in the above described Japanese Patent Publication No. 19909/1975 with a view to avoiding such distortion as shown in FIG. 3. Referring to FIG. 5, the X axis is parallel to the in-line direction, passing through the center of the shadow mask and the Y axis passing through the center is vertical to the X axis. As seen in FIG. 5, rows of apertures of the shadow mask in the direction of the X axis are curved in the shape of a barrel, while columns of apertures in the direction of the Y axis are curved in the shape of a pincushion. Such array of apertures makes it possible to correct such distortion as shown in FIG. 3 to take a closer approach to the ideal state as shown in FIG. 4. However, the rows and columns of such array of apertures are not parallel to the X axis or to the Y axis and, as a result, the manufacturing of such a mask is complicated and expensive.

On the other hand, some other arrays of apertures are proposed for the purpose of solving the above described problem. However, they are improved arrays only in one dimension (only in one direction) and none of them can solve the above described problem satisfactorily.

SUMMARY OF THE INVENTION

It is an object of the present invention to provide a color CRT comprising a shadow mask, in which an array of apertures of the shadow mask has a two-dimensionally improved pattern with a better effect than in case of an one-dimensionally improved pattern and such minimum distance as that between $R_1$ and $B_3$ in FIG. 3 is made longer to allow a larger landing tolerance of the electron beams.

It is another object of the invention to provide a color CRT comprising a shadow mask with a two-dimensionally improved array of apertures, in which the array of apertures can be manufactured more easily and at lower cost than conventional two dimensionally improved arrays.

A color CRT in accordance with an embodiment of the present invention comprises a set of three electron guns in an in-line array, a shadow mask with a curved surface having a plurality of circular small apertures and a fluorescent screen disposed in parallel with the shadow mask and including fluorescent dots arrayed in association with three electron beams passing through the apertures, and the shadow mask includes an X axis and a Y axis passing through the center in the flat state before the mask is pressed to have a curved surface, the X axis being horizontal in parallel with the direction of the above stated in-line array, the Y axis being vertical to the X axis, rows of the apertures in the direction of the X axis being curved more prominently in the shape of a barrel according to increase of the distance from the X axis and columns of said apertures in the direction of the Y axis being all straight lines parallel to the Y axis.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
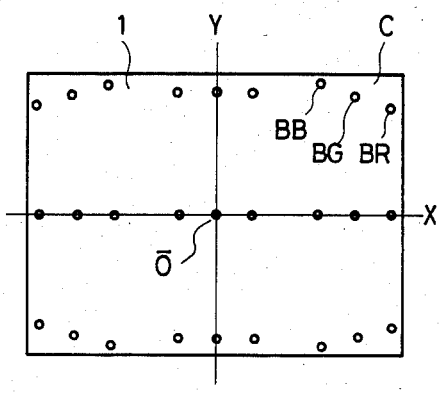
FIG. 2 is a schematic illustration for explaining inclinations of trios of electron beams in the vicinity of corner portions on a fluorescent screen.
Figure 3:
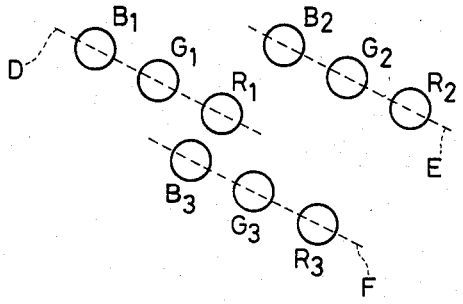
FIG. 3 is a more detailed illustration showing a corner portion C in FIG. 2.
Figure 4:
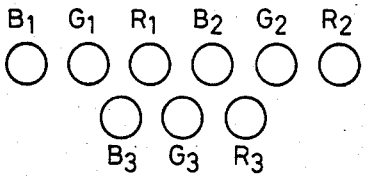
FIG. 4 is a schematic illustration showing a pattern of arrival points of electron beams in the ideal case.
Figure 6:
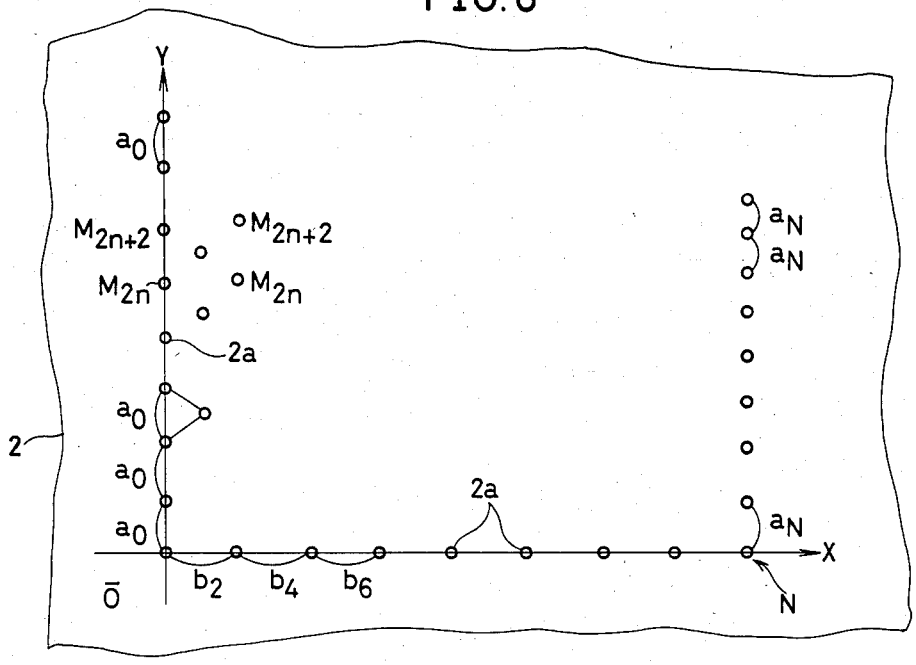
FIG. 6 is a schematic illustration for explaining a distribution of apertures in a shadow mask in a color CRT in accordance with an embodiment of the present invention.

Referring to FIG. 6, the center $\overline{O}$ of a shadow mask corresponds to the center of the fluorescent screen shown in FIG. 2 and the horizontal X axis passing through the center $\overline{O}$ is parallel with the in-line direction, the Y axis through the center $\overline{O}$ being vertical to the X axis. In an array of apertures of the shadow mask in FIG. 6, rows of apertures arrayed in the X axis direction are curved more prominently in the shape of a barrel as the distance from the X axis becomes larger, while columns of apertures in the Y axis direction are all arrayed in straight lines parallel to the Y axis irrespectively of the distance from the Y axis.

On the Y axis, apertures 2a in an even-numbered row $M_{2n}$ (n being an integer) are provided at a pitch $a_0$ and on the X axis, apertures 2a in an even-numbered column $N_{2n}$ are provided at a pitch $b_{2n}$. In the column $N_{2n}$, apertures 2a are provided at a pitch $a_N$ in the Y axis direction.

An aperture in an odd-numbered column $N_{2n+1}$ is at a position surrounded by the $M_{2n}$th and the $Mh_{2n+2}$th apertures in the Y axis direction belonging in the even-numbered columns $N_{2n}$ and $N_{2n+2}$ adjacent to both sides of column $N_{2n+1}$, the above stated position being separated by almost the same distance from the four apertures (see FIG. 6). More specifically, a first aperture in the Y axis direction belonging in the odd-numbered column $N_{2n+1}$ is at a position of $Y=a_N/2$ and apertures are arrayed at a pitch $a_N$ from the first aperture in parallel with the Y axis.

Figure 7A:
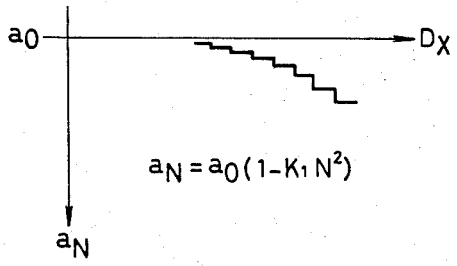
FIG. 7A is a diagram showing a gradual change in the pitches of apertures of a shadow mask in the direction of the Y axis in accordance with the present invention.

The vertical axis in FIG. 7A represents a gradual change of pitches $a_N$ of the apertures in the Y axis direction in relation to $a_0$, while the horizontal axis represents the distance $D_X$ from the origin $\overline{O}$ to the Nth column. For example, a pitch $a_N$ in the column N is represented by the following equation:

$$a_N=a_0(1-K_1N^2)$$

where preferably $a_0=0.368$ mm and $K_1=7.59\times10^{-8}$ mm.

Figure 7B:
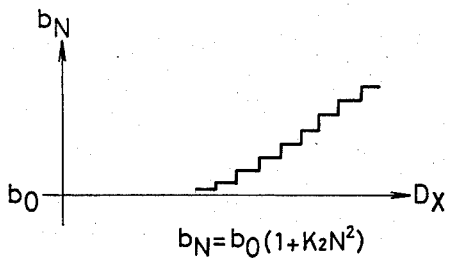
FIG. 7B is a diagram showing a gradual change in pitches of apertures of a shadow mask in the direction of the X axis in accordance with the present invention.

FIG. 7B is a diagram representing a gradual change of pitches $b_N$ of columns in the X axis direction. The vertical axis in FIG. 7B represents the change of pitches $b_N$ between the columns in relation to $b_0$, while the horizontal axis represents the distance from the origin $\overline{O}$ to the column N. More specifically, a distance between a column N and a column (N+1) is set to be increased as N becomes large. For example, the following equation can be specifically established:

$$b_N=b_0(1+K_2N^2)$$

where $b_0$ indicates the distance between the column (N=0) on the Y axis and the adjacent column (N=1 or N=−1) and preferably $b_0=0.554$ mm, $K_2=3.06\times10^{-7}$ mm and $b_N=0.637$ mm in the case where N=700.

As a specific example, in a corner of a 20-inch CRT for example, an angle between a line connecting the arrival points of a trio of electron beams and the X axis is approximately 3° to 6°. Generally, the inclination of a trio of electron beams is larger than the inclination of a trio of associated fluorescent dots and, therefore, the inclination of a row in the shadow mask is preferably 3° to 4°. The change of pitches $a_N$ shown in FIG. 7A serves to correct a difference of inclination angles in the trios of electron beams passing through the vertically adjacent apertures more effectively than possible in a conventional CRT such as the type depicted in FIG. 1. Furthermore, according to the present invention, a larger space can be obtained between the respective trios of beams in the Y axis direction by making a pitch $a_N$ in the Y axis direction larger than is the case in a conventional CRT.

Figure 8:
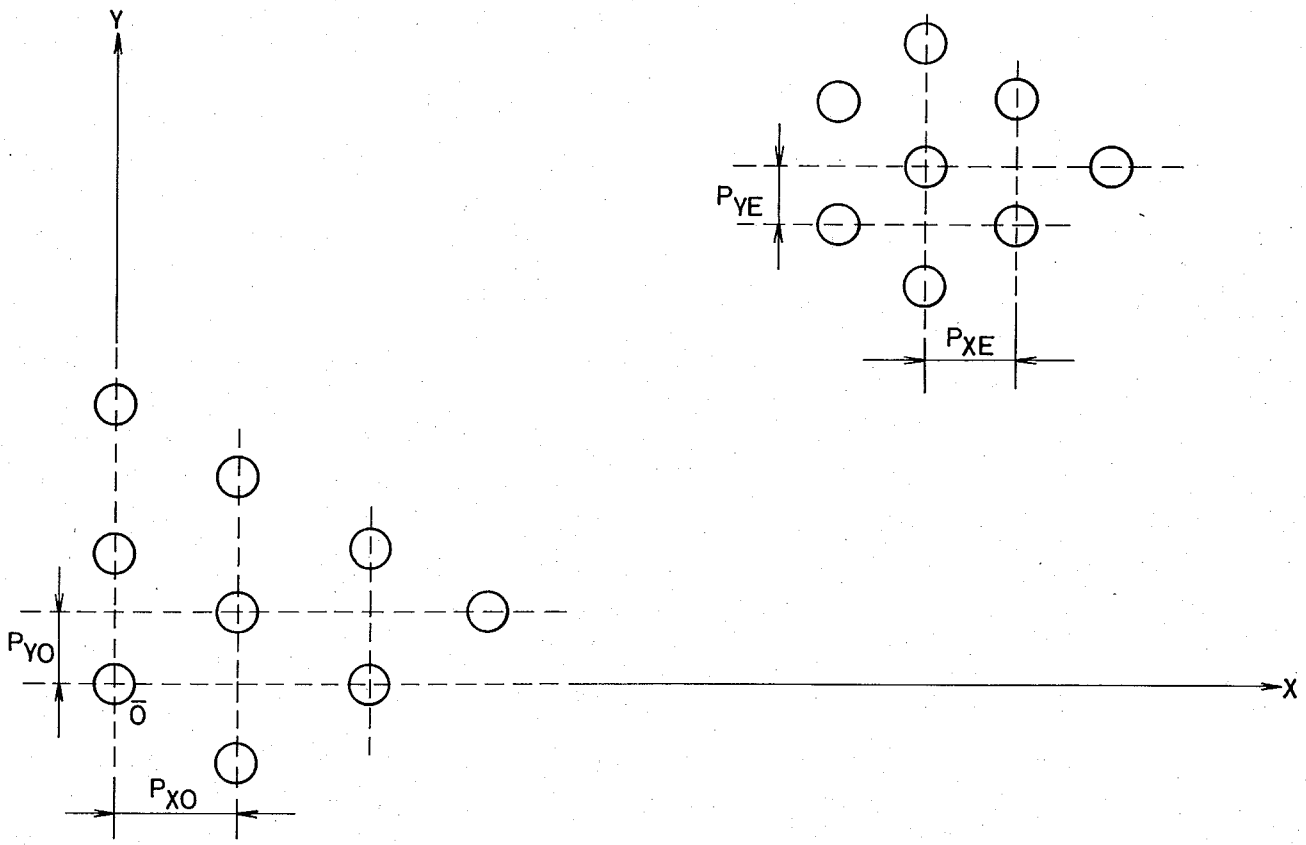
FIG. 8 is a schematic illustration for explaining pitches in an array of apertures in the center and in a corner portion of a shadow mask.

For the purpose of clarifying a difference between a shadow mask of the present invention and a conventional shadow mask, the following description will be made with reference to FIG. 8. Similarly to FIG. 6, FIG. 8 shows several apertures in the center and in a corner portion of a shadow mask. As shown in FIG. 8, the component in the Y axis direction, i.e., to the distance from the aperture at the origin $\overline{O}$ to the nearest aperture in the next row ($M=1$ or $M=-1$), is $P_{YO}$ ($=a_0/2$) and the component in the X axis is $P_{XO}$ ($=b_2/2$) which corresponds to the distance between the columns $N=0$ and $N=1$ (or $N=-1$). Similarly, in a corner portion of the shadow mask, the components in the X axis direction and the Y axis direction are defined as $P_{YE}=a_N/2$ and $P_{XE}=b_N$, respectively. Although a row of apertures in a corner portion of the shadow mask is not strictly parallel to the X axis, such a row in FIG. 8 is shown as being parallel to the X axis for the purpose of making a clearer comparison with a row of apertures in the center. However, this does not affect the definition of $P_{YE}$ and $P_{XE}$.

According to the definition in FIG. 8, in the array of apertures of the shadow mask as described in the above stated embodiment the following three relations are established.

$$P_{XO}/\sqrt{3} < P_{YO} \leqq 1.2\,P_{XO} \quad (1)$$

$$P_{XO} \leqq P_{XE} \leqq 1.2\,P_{XO} \quad (2)$$

$$P_{YO} - 25 \leqq P_{YE} < P_{YO} \quad (3)$$

(μm)

Regarding the three relations, the relation (3) serves principally to correct a difference in inclination angles in the vertically adjacent beam trios and the relation (2) serves to take a sufficient spacing in the X axis direction.

The relation (1) has a meaning as described in the following. For a high resolution CRT (HRCRT), electron beams are required to be narrowly applied and pitches of apertures in a shadow mask need to be small. On the other hand, since the close packed structure is conventionally adopted for an array of apertures of a shadow mask, the nearest three apertures form a regular triangle. In other words, a relation of $P_{YO}/P_{XO}=1/\sqrt{3}$ is established. Accordingly, the resolution of a HRCRT is lower in the X axis direction and $P_{XO}$ is regarded as a substantial resolving power. Considering this point also, the present invention intends to make an improved distribution of apertures. More specifically, since a relation of $P_{YO}=P_{XO}/\sqrt{3}$ is established in a conventional shadow mask and the overresolution in the vertical Y axis direction can give another capacity for further improvement, the present invention intends to utilize this capacity for improvement of the color purity. According to the present invention, $P_{YE}$ is always set to be smaller than $P_{YO}$ (for example, $P_{YE}=P_{YO}-15$ μm approximately in a corner portion) and, as a result, if a relation of $P_{YE}=P_{XE}$ in a corner portion is regarded as a limit, the increase of $P_{YO}$ is limited to an increase of about 20% of $P_{XO}$, similarly to the above stated relation (2). This limitation also serves for preventing characters and the like represented in a corner portion of a CRT from appearing differently as compared with the same characters and the like represented in the center.

Figure 9A:
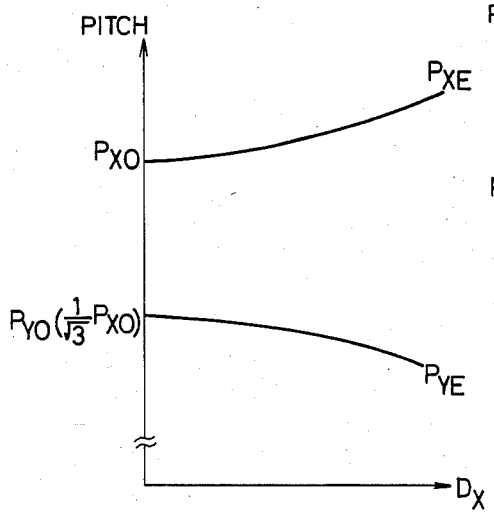
FIG. 9A is a diagram showing a gradual change in pitches in an array of apertures of a shadow mask in accordance with an embodiment of the present invention.

FIG. 9A shows a gradual change in the pitches of apertures in case where the above stated relations (2) and (3) in accordance with the present invention are applied under the condition of $P_{YO}=P_{XO}/\sqrt{3}$. In FIG. 9A, the vertical axis represents pitches of apertures and the horizontal axis is related to the component in the X axis direction as to a distance from the center $\overline{O}$ of a shadow mask to an aperture. Although the change is practically made in a stepped form as shown in FIG. 7A, such change is represented as a smooth curve in FIG. 9A for simplification of the illustration.

Figure 9B:
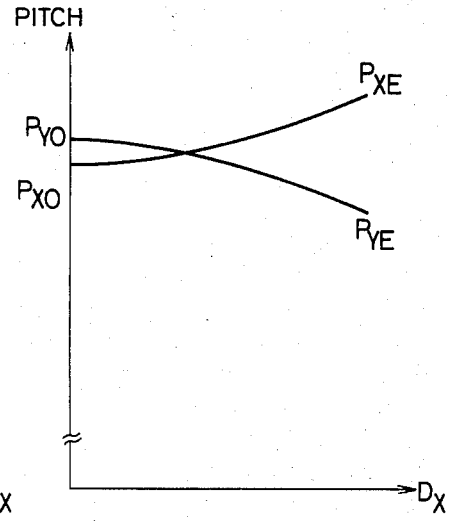
FIG. 9B is a diagram showing a gradual change in pitches of apertures in a shadow mask in accordance with another embodiment of the present invention.

FIG. 9B shows the similar change in the pitches of improved apertures, taking account of the relation (2) also. In FIG. 9B, the array of apertures is made so that $P_{YO}$ is, for example, set to $P_{YO}=P_{XO}+5$ (μm) and the pitch $P_{YE}$ in a corner portion is approached to $P_{XE}$.

Figure 10:
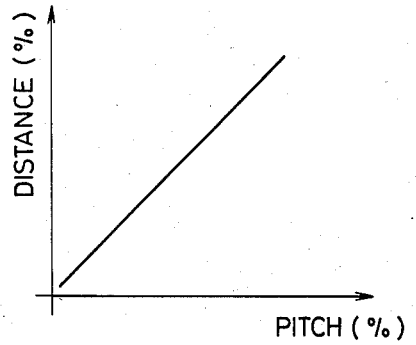
FIG. 10 is a diagram showing a relation between percentages of correction of pitches of adjacent apertures in a shadow mask and percentages of correction of the distance between the nearest arrival points of electron beams.

FIG. 10 is a diagram for explaining improvement of the space factor by the change of the pitch of apertures. Referring to FIG. 10, the horizontal axis represents percentages of the increase in the pitch of apertures and the vertical axis represents percentages (%) of the increase in the distance between the nearest arrival points of the electron beams. As shown in the drawing, the distance between the nearest arrival points of the beams becomes large in proportion to increase in the pitch of apertures so that the space factor is improved. For example, in case of $P_{XO}=0.3\times(\sqrt{3}/2)$ and $P_{XE}=0.3\times(\sqrt{3}/2)\times1.15$, in other words, in a case where the pitch in the X axis direction in a corner portion is increased by 15%, the space factor in the horizontal direction becomes improved by 15% and the distance between the nearest arrival points of the electron beams becomes large by about 4%, for example, about 7 μm in a practical size of a corner portion of a 20-inch CRT.

Figure 1:
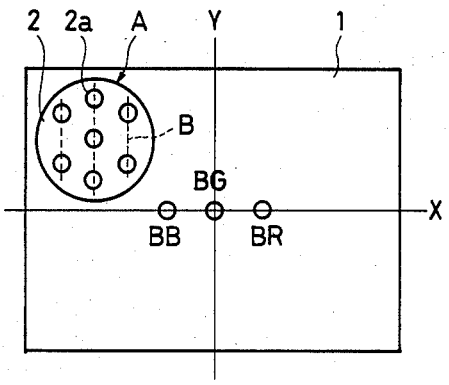
FIG. 1 is a schematic illustration showing a relation between an in-line array of electron beams and an array of apertures of a shadow mask in a conventional color CRT.

In addition, since the pitch $P_{YO}$ of apertures in the Y axis direction in accordance with the present invention is made large within the range of the relation (1), this pitch may be, for example, 0.368/2 mm in FIG. 6, which is larger by about 15% than a pitch of 0.320/2 mm in the center of such a conventional CRT as in FIG. 1 and the distance between the nearest arrival points of the electron beams is improved by about 20 μm including the component improved in the X axis direction as described above.

The reason why such a great improvement can be obtained in the corner portion is that since there is conventionally an overresolution in the Y axis direction, and such overresolving power is reduced a little in the center, to give a capacity for improvement of the space factor in the corner portion. In contrast to an ordinary CRT, the brightness in the peripheral portions in a HRCRT becomes more important at the time of setting the brightness and, therefore, such a slight reduction in the resolving power in the center is permissible.

However, the increase of the pitch of apertures of the shadow mask in the Y axis direction involves a disadvantage that if a "moiré" is caused by interference between the increased pitch and the scanning distance of the electron beams, such moiré will tend to appear perceptible. Generally, the pitch of apertures of the shadow mask in a HRCRT is so small and in the order of about ½ of the distance between the scanning lines of electron beams and, therefore, such increase of the pitch will practically cause no problem.

Figure 5:
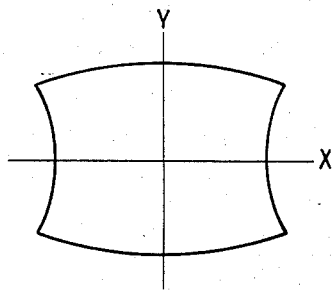
FIG. 5 is a schematic illustration for explaining a curved array of rows and columns of apertures of a conventional shadow mask proposed for the purpose of avoiding such distortion as shown in FIG. 3.

As described previously, in the distribution of apertures of the shadow mask in FIG. 5, the rows of apertures in the X axis direction are in the shape of a barrel and the columns of apertures in the Y axis direction are in the shape of a pincushion, while in accordance with the present invention, only the rows of apertures in the X axis direction are in the shape of a barrel and all the columns of apertures are straight lines parallel to the Y axis. Accordingly, an array of apertures of a shadow mask in accordance with the present invention can be easily formed at a lower cost as compared with the array shown in FIG. 5. In an embodiment in FIG. 6, description was made of a case where the pitches of apertures (or columns) in the X axis direction were gradually made larger, as shown in FIG. 7B. However, such a case involves a disadvantage concerning the resolution if the pitch in the X axis direction becomes too large in a corner (or side) portion. Consequently, if the resolution in the X axis direction in a corner (or side) portion is a matter of importance, it goes without saying that the pitches may be set to satisfy the above stated relations (1) and (3) only in the Y axis direction with a fixed condition of $P_{XE}=P_{XO}$.

Although, in the foregoing embodiment, a case where the pitch of apertures in the Y axis direction in each column N was a fixed value of $a_N$ was described, this pitch need not always be set to the fixed value. It is important that the rows of apertures in the X axis direction be in the shape of a barrel and all the columns of apertures be straight lines parallel to the Y axis. In many cases, HRCRTs are utilized for representation of characters, graphs etc. In such cases, the tolerance of the pitch of apertures of the shadow mask in the Y axis direction is limited to about ±25 μm (a difference of 50 μm). In addition, as described previously, the correction of the pitch of apertures in the X axis direction is limited to about a 20% increase as compared with a conventional CRT. For example, if the pitch in the Y axis direction in the close packed structure is 0.300 mm, the pitch in the X axis direction is approximately 0.52 mm and, where these values are selected in the center, it is made clear that the practical limit value of the pitch $P_{XE}$ in the X axis direction is approximately 0.62 mm. In the HRCRT, a remarkable improvement is made as to the distance between the nearest arrival points of the electron beams as shown in an embodiment of the present invention (approximately 20 μm in a corner portion of a 20-inch CRT). Further, the improvement makes it possible not only to enlarge the permissible landing tolerance of electron beams in the finished color CRTs but also to noticeably improve the efficiency of manufacturing a fluorescent screen.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A color cathode-ray tube, comprising:

a set of three electron guns provided in an in-line array for emitting three electron beams;

a shadow mask with a curved surface disposed ahead of paths of said electron beams from said electron guns, in a direction intersecting with said paths, said shadow mask having a plurality of circular small apertures and the respective apertures transmitting sets of said electron beams;

a fluorescent screen with a curved surface disposed in parallel with said shadow mask, said fluorescent screen including sets of three fluorescent dots for three different colors at positions respectively associated with said three electron beams passing through each said aperture of said shadow mask; and said shadow mask including, in its flat state before bring formed to have a curved surface, an X axis and a Y axis passing through the center of said flat mask, the X axis being horizontal in parallel with the direction of said in-line array, the Y axis being vertical to the X axis, rows of said apertures in the X axis direction being curved more prominently in the shape of a barrel according to increase of the distance from the X axis and columns of said apertures in the Y axis direction being all straight lines parallel to the Y axis;

wherein $P_{XO}$ is the distance from the column on the Y axis to the next adjacent column; $P_{YO}$ is half the distance from the aperture on said center to the adjacent aperture on the Y axis; $P_{XE}$ is the distance between adjacent columns located in a corner portion of said flat mask; and $P_{YE}$ is half the associated distance between the adjacent apertures in a column located in said corner portion of said flat mask; $P_{XO}$, $P_{XE}$ and $P_{YE}$ being selected such that the following relations are satisfied:

$$P_{XO} \leqq P_{XE} \leqq 1.2P_{XO}$$

$$P_{YO}-25 \leqq PO_{YE} < P_{YO}\ (\mu m),$$

and wherein the distances $P_{YE}$ and $P_{YO}$ are selected such that a relation: $P_{YE}=P_{YO}(1-K_1N^2)$ is satisfied, where $K_1$ is a constant and N is a column number counted from said center (N=∅ corresponding to the column on the Y axis).

2. A color cathode-ray tube in accordance with claim 1, wherein the distances $P_{XE}$ and $P_{XO}$ are selected such that a relation: $P_{XE}=P_{XO}(1+K_2N^2)$ is satisfied, where $K_2$ is a constant.

3. A color cathode-ray tube in accordance claim 1, wherein $P_{YO}=0.189$ mm and $K_1=7.59\times10^{-8}$ mm.

4. A color cathode-ray tube, comprising:

a set of three electron guns provided in an in-line array for emitting three electron beams;

a shadow mask with a curved surface disposed ahead of paths of said electron beams from said electron guns, in a direction intersecting with said paths, said shadow mask having a plurality of circular small apertures and the respective apertures transmitting sets of said electron beams;

a fluorescent screen with a curved surface disposed in parallel with said shadow mask, said fluorescent screen including sets of three fluorescent dots for three different colors at positions respectively associated with said three electron beams passing through each said aperture of said shadow mask; and said shadow mask including, in its flat state before being formed to have a curved surface, an X axis and a Y axis passing through the center of said flat mask, the X axis being horizontal in parallel with the direction of said in-line array, the Y axis being vertical to the X axis, rows of said apertures in the X axis direction being curved more prominently in the shape of a barrel according to increase of the distance from the X axis and columns of said apertures in the Y axis direction being all straight lines parallel to the Y axis;

wherein $P_{XO}$, the distance from the column on the Y axis to the adjacent column, and $P_{YO}$, half the distance from the aperture on said center to the adjacent aperture on the Y axis, are selected such that the following relation is satisfied:

$$P_{XO}/\sqrt{3} < P_{YO} \leqq 1.2\ P_{XO},$$

and wherein $P_{XE}$ is the distance between adjacent columns located in a corner portion of said flat mask, and $P_{YE}$ is half the associated distance between adjacent apertures in a column; $P_{XO}$, $P_{XE}$ and $P_{YE}$ being selected such that:

$$P_{XO} \leqq P_{XE} \leqq 1.2\ P_{XO}$$

$$P_{YO}-25 \leqq P_{YE} \leqq P_{YO},$$

and wherein the distances $P_{YE}$ and $P_{YO}$ are selected such that a relation: $P_{YE}=P_{YO}(1-K_1N^2)$ is satisfied, where $K_1$ is a constant and N is a column number counted from said center (N=0 corresponding to the column on the Y axis).

5. A color cathode-ray tube, comprising:

a set of three electron guns provided in an in-line array for emitting three electron beams;

a shadow mask with a curved surface disposed ahead of paths of said electron beams from said electron guns, in a direction intersecting with said paths, said shadow mask having a plurality of circular small apertures and the respective apertures transmitting sets of said electron beams;

a fluorescent screen with a curved surface disposed in parallel with said shadow mask, said fluorescent screen including sets of three fluorescent dots for three different colors at positions respectively associated with said three electron beams passing through each said aperture of said shadow mask; and said shadow mask including, in its flat state before being formed to have a curved surface, an X axis and a Y axis passing through the center of said flat mask, the X axis being horizontal in parallel with the direction of said in-line array, the Y axis being vertical to the X axis, rows of said apertures in the X axis direction being curved more prominently in the shape of a barrel according to increase of the distance from the X axis and columns of said apertures in the Y axis direction being all straight lines parallel to the Y axis;

wherein $P_{XO}$, the distance from the column on the Y axis to the adjacent column, and $P_{YO}$, half the distance from the aperture on said center to the adjacent aperture on the Y axis, are selected such that the following relation is satisfied:

$$P_{XO}/\sqrt{3} < P_{YO} \leqq 1.2\ P_{XO},$$

and wherein $P_{XE}$ is the distance between adjacent columns located in a corner portion of said flat mask, and $P_{YE}$ is half the associated distance between adjacent apertures in a column; $P_{XO}$, $P_{XE}$ and $P_{YE}$ being selected such that $$P_{XO} \leqq P_{XE} \leqq 1.2\ P_{XO}$$

$$P_{YO}-25 \leqq P_{YE} < P_{YO},$$

and wherein the distances $P_{XE}$ and $P_{XO}$ are selected such that a relation: $P_{XE}=P_{XO}(1+K_2N^2)$ is satisfied, where $K_2$ is a constant and N is a column number counted from said center (N=∅ corresponding to the column on the Y axis).

6. A color cathode-ray tube in accordance with claim 5, wherein $P_{XO}=0.277$ mm and $K_2=3.06\times10^{-7}$ mm.

7. A color cathode-ray tube in accordance with claim 4, wherein the distances $P_{XE}$ and $P_{XO}$ are selected such that a relation: $P_{XE}=P_{XO}(1+K_2N^2)$ is satisfied, where $K_2$ is a constant.

* * * * *